United States Patent [19]

Milde

[11] Patent Number: 4,488,885

[45] Date of Patent: Dec. 18, 1984

[54] ELECTROSTATIC CHARGING APPARATUS

[75] Inventor: Helmut I. Milde, Boxford, Mass.

[73] Assignee: High Voltage Engineering Corporation, Burlington, Mass.

[21] Appl. No.: 438,327

[22] Filed: Nov. 1, 1982

[51] Int. Cl.[3] ..... B03C 3/08; B03C 3/38

[52] U.S. Cl. ..... 55/139; 361/235; 323/903

[58] Field of Search ..... 55/2, 123, 138, 139; 361/226, 227, 233, 235; 323/903

[56] References Cited

U.S. PATENT DOCUMENTS

| | | | |
|---|---|---|---|
| 2,251,451 | 8/1941 | Heinrich | 55/2 |
| 2,440,455 | 4/1948 | White | 55/2 |
| 3,520,172 | 7/1970 | Liu et al. | 55/139 |
| 3,945,813 | 3/1976 | Iinoya et al. | 55/139 |
| 4,133,649 | 1/1979 | Milde | 55/2 |

*Primary Examiner*—David Lacey

*Attorney, Agent, or Firm*—Henry C. Nields

[57] ABSTRACT

A charging apparatus constructed to provide a continuous ac voltage and periodic pulses between the corona electrodes and non-corona electrodes contained therein.

2 Claims, 3 Drawing Figures

ELECTROSTATIC CHARGING APPARATUS

BACKGROUND OF THE INVENTION

This invention relates to the first stage of two-stage electrostatic precipitators having corona electrodes and non-corona electrodes, wherein particulates entrained in a gas are electrostatically charged in order to enable precipitation thereof from the gas by passing a stream of the gas having the particulates contained therein between the corona electrodes and non-corona electrodes of the first stage of the electrostatic precipitator.

The performance of electrostatic precipitators is often hampered by a phenomenon known as back corona. During operation of electrostatic precipitators a corona is created in the vicinity of the corona electrodes between the corona electrodes and the collecting electrodes. The ions formed in the corona attach themselves to particulates so as to cause these particulates to acquire electric charge, and the thus-charged particulates (together with the unattached ions from the corona) move as a current toward the collecting electrodes where they rest, forming a dust layer. As the dust layer forms, the current must continue its existence through the dust layer in order to reach the collecting electrode underneath the dust layer. Back corona sets in when the current density of the current through the dust layer on the collecting electrode exceeds a certain value. At this critical value the electric field through the dust layer produces electrical discharges in the dust layer and injects charges of polarity, opposite to that of the moving charges in the aforesaid current, into the gas stream and neutralizes at least partially the charge on the particles.

It is also a well established fact that the current through the dust layer is primarily due to ion current and only a very small portion is due to charged particles. See, for example: H. J. White, "The Role of Corona Discharge in the Electrical Precipitation Process", Electrical Engineering, January (1952) pg. 67–73. In other words, back corona is caused by current which has crossed the gap between corona wires and collecting electrode without having performed a major useful function. If one were to make the ions oscillate back and forth many times inside the gas stream before being collected, one would give the ions a better chance to attach themselves to particles and they would also contribute less to the current flowing through the dust layer.

Prior art proposals for apparatus for carrying out a two stage precipitation process, where the particles are charged in a first stage and collected in a second stage, are disclosed for example, in U.S. Pat. No. 2,440,455 to White and U.S. Pat. No. 2,251,451 to Heinrich. The collecting stage can be of the standard wire-plate arrangement having at least one wire as a corona electrode and at least one plate as a collecting electrode; a dc voltage is applied between the corona electrode and the collecting electrode and, if desired, pulse voltages may be superimposed on the dc voltage. Preferably an arrangement would be chosen which produces a field within the duct of enhanced uniformity.

White proposes in his said patent the use of a special 3-electrode arrangement. Ac is applied to non-discharge electrodes and pulses are applied to special discharge electrodes between the non-discharge ac electrodes.

Heinrich in his said patent proposes the use of asymmetrical current impulses, which makes the ac frequency equal to the pulse repetition frequency.

Judging from FIG. 2 of Heinrich's said patent and the apparatus described therein, it appears that he is thinking of pulses with a pulse width on the order of milliseconds. (Even though FIG. 2 shows no reference to time, Heinrich mentions on page 4, column 1, line 21 a desired impulse frequency of 100 pulses per second. Using this frequency and assuming that FIG. 2 is to scale indicates a pulse width in excess of 2 milliseconds.)

SUMMARY OF THE INVENTION

In accordance with my invention, charging in the charging stage of a two-stage electrostatic precipitator is secured by applying to one or more corona wires of the charging stage a continuous ac voltage and periodic unipolar pulse voltages. The ac voltage will cause the ions constituting the corona discharge to oscillate back and forth within the duct, while the pulse voltage will produce the ions and move them towards the non-corona electrode, thus filling the entire duct with oscillating ions. The various parameters are carefully chosen in accordance with my invention. The pulse voltage should be high enough to produce the desired quantity of ions without initiating breakdown. The pulse duration and interpulse period (repetition rate or "rep" rate) should be chosen in such a way that the ions are propagated towards the non-corona electrode and fill the entire duct before exiting the charging zone as a result of their motion in the direction of flow of the stream of gas. The oscillating period of the ac voltage should be chosen so that the ions oscillate within the duct area and are not intercepted by the electrodes. By this method they are given repeated opportunities to attach themselves to particles.

Unlike White's special 3-electrode arrangement, the operation of my invention can be accomplished by a simple wire in a standard duct, and the ac and pulse voltage are applied to the same electrodes. Unlike Heinrich's asymmetrical current impulses, in accordance with my invention the use of a symmetrical ac wave is suggested. The pulse repetition frequency is different from the ac frequency and follows desired guidelines. A pulse of 100 microseconds or less is employed.

DETAILED DESCRIPTION OF A PREFERRED EMBODIMENT

Figure 1:
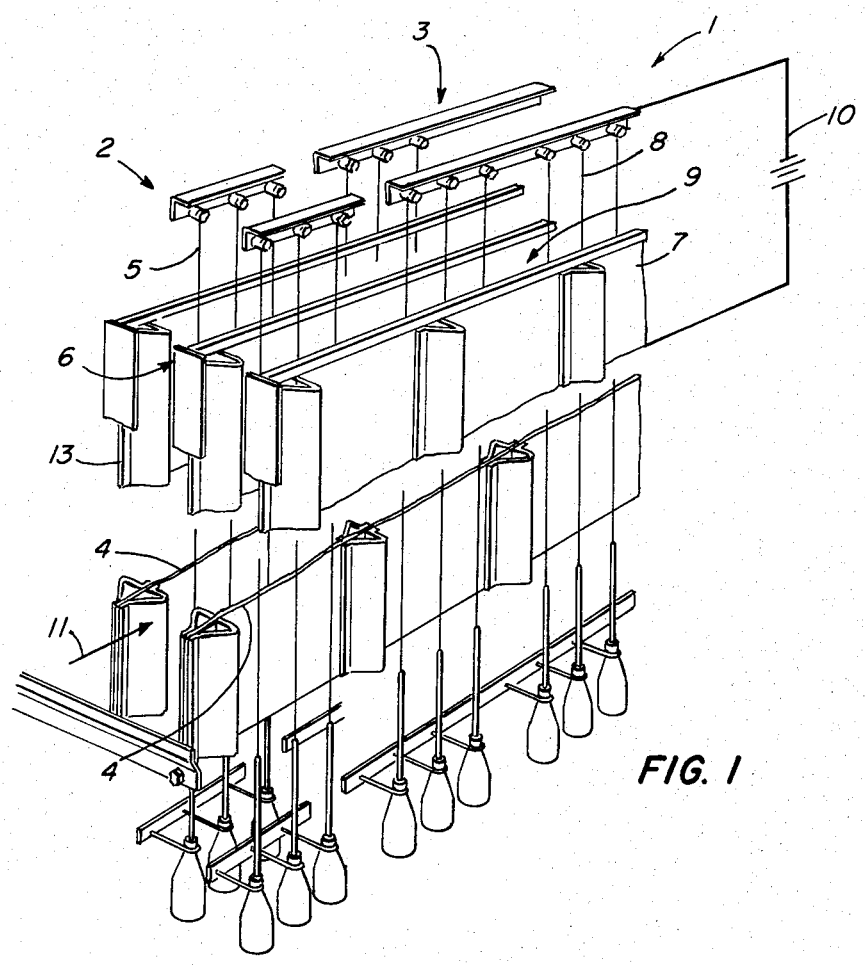
FIG. 1 is a three-dimensional view of the electrode configuration of a two-stage duct type precipitator useful for collection of fly ash.

As shown in FIG. 1, a two-stage electrostatic precipitator 1 includes a charging stage 2 and a collecting stage 3. In accordance with my invention the charging stage 2 includes a plurality of spaced, non-corona electrodes 4 and a plurality of metallic corona electrodes 5 of relatively small surface area positioned within the channel-like spaces 6 midway between each pair of electrode plates 4. Although my invention is not limited to any particular type of non-corona electrodes, for purposes of illustration the non-corona electrodes 4 of FIG. 1 are shown as metallic electrode plates. The collecting stage 3 may include a plurality of spaced metallic collecting plates 7 and a plurality of metallic corona electrodes 8 of relatively small surface area positioned within the channel-like spaces 9 midway between each pair of collecting plates 7. A suitable dc voltage, with or without pulse voltages superimposed thereon, may be applied between the collecting plates 7 and the corona electrodes 8 by a suitable voltage source 10.

Figure 2:
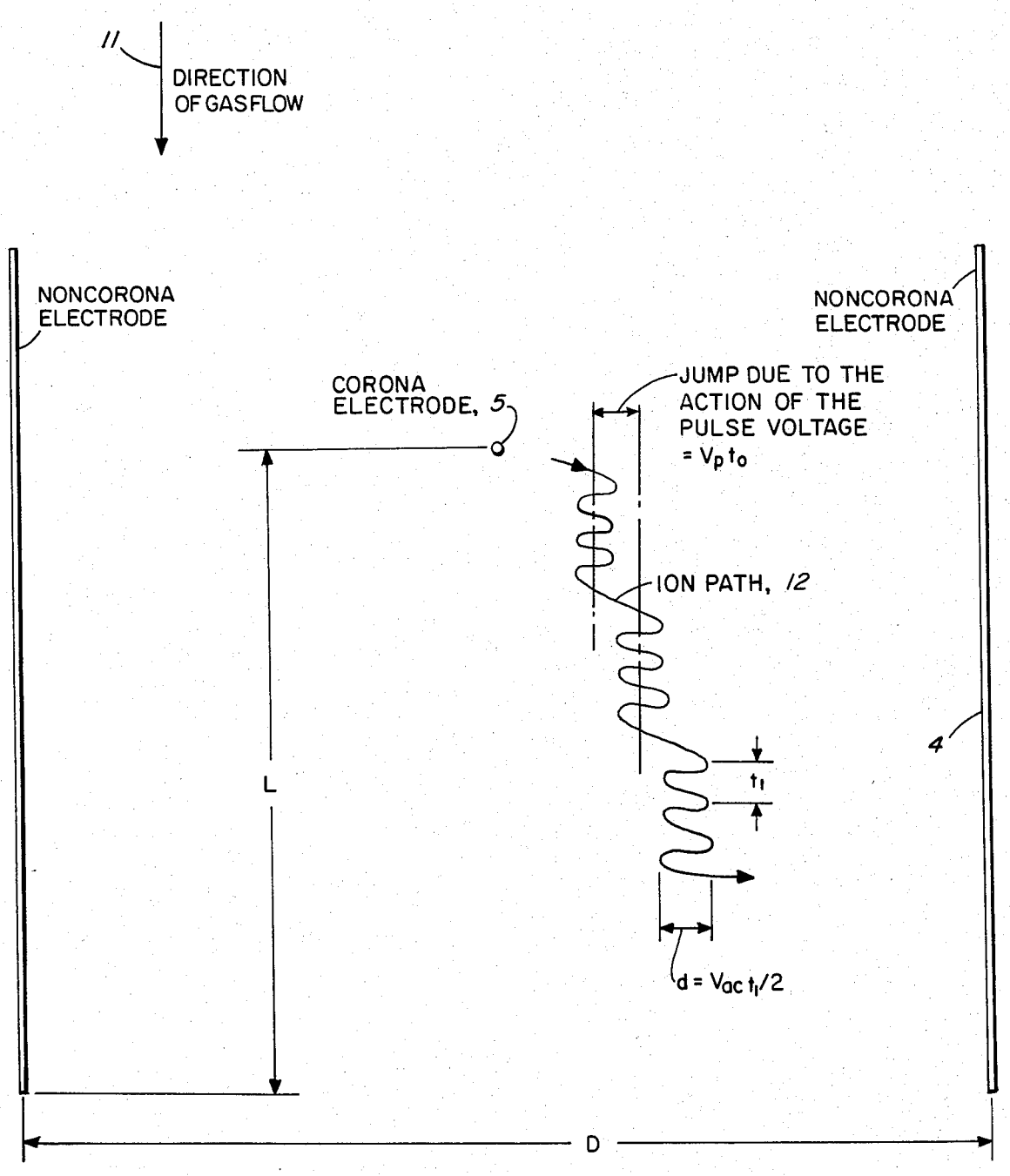
FIG. 2 is a plan view of a single discharge electrode and adjacent non-corona electrodes of the charging stage of the precipitator of FIG. 1 arranged in accordance with the invention, also showing the path of an ion under the action of the ac and pulsed field.

Referring to FIG. 2, therein is shown the geometry of the charging stage 2 in which the production of corona results in the ionization of some gas particles traveling through the charging stage 2 in the vicinity of the corona electrodes 5. Movement of these ions from the corona towards the non-corona electrodes 4 results in the production of charged particulates. The electrode plates 4 in general will be grounded, and in accordance with the invention a continuous ac voltage is applied to the corona wires 5. In addition periodic unipolar pulse voltages are also applied to the corona wires 5. In operation a gas stream 11 is caused to flow through the channel-like spaces 6.

FIG. 2 shows the path of an ion under the action of the ac and pulsed field. The ion path is indicated at 12, which shows that as the ion progresses in the direction of gas flow it also moves in a direction transverse to that of gas flow: i.e., along a direction between the corona electrode 5 and the electrode plate 4. The ac field (whose frequency may be designated as $f_1$) causes the ion to move back and forth relatively rapidly with relatively small amplitude. After several cycles of this motion the imposition of the pulsed field during a time $t_o$ (i.e., the pulse width) imparts motion which translates the ion towards the electrode plate 4 in a jump which is of the order of magnitude of the amplitude of the oscillation caused by the ac field. If the average ion migration velocity during the pulse period is designated $V_p$, then the displacement of the ion during the pulse (i.e. the spatial pulse width) is $V_p t_o$. If the pulse repetition frequency is designated as $f_2$ hertz, then the displacement of the ion occurs at a rate of $f_2 V_p t_o$ per second. The spatial amplitude of the motion caused by the ac field is designated as d, and the temporal period of the oscillation of the ac field is designated as $t_1$. Consequently, during the period of $t_1$ the average ion travels a distance 2d, and so the average ion migration velocity in a direction transverse to that of gas flow during the application of the ac voltage between pulses is equal to $2d/t_1$ and may be designated as $V_{ac}$. The ion whose path is shown in FIG. 2 originates near the corona electrode 5, and it is desired that it travel in the direction of gas flow until free of the electrode plate 4; the distance along the direction of gas flow which the ion must thus travel has been designated as L. If the gas velocity is designated as $V_g$, the average ion will traverse the distance L in a time $L/V_g$. The distance between electrode plates 4 has been designated as D, and it is assumed that the corona electrode 5, which extends perpendicular to the plane of the drawing, is placed midway between the electrode plates 4. Usually the electrode plates 4 are formed by the walls of the duct through which the gas stream flows.

The following discussion defines the important relationships which must be satisfied if the objectives of the invention are to be accomplished.

IMPORTANT RELATIONSHIPS

The motion of the ions will be affected not only by electric forces but also by drag forces of the turbulent gas stream. It is therefore difficult to establish rigorous mathematical relationships, but nonetheless approximate relationships can be derived and are stated below.

Relationship (1)

The spatial amplitude (d) of the oscillating motion of the ions due to the ac field should be much smaller than the duct dimension D.

Relationship (2)

The rate at which the average ion is displaced transverse to the direction of gas flow (which, as pointed out hereinbelow, is equal to the product of spatial pulse width ($V_p t_o$) and pulse repetition rate ($f_2$)) should be no greater than large enough to allow ions to cross the gap between corona electrode 5 and electrode plate 4 within the charging zone. A rate slightly less, so that collecting occurs exclusively in the collection section, would possibly be better.

Relationship (3)

Paths of ions produced during one pulse should overlap paths of ions produced in previous pulse; i.e., the spatial amplitude d of oscillation should be greater than the displacement $V_p t_o$ during the pulse.

Relationship (4)

Charging time should be small in comparison to the time particle spends in charging zone. As shown hereinabove, the ion spends L/Vg in the charging zone. "Charging time" is the time required to charge a particulate to 50% of the maximum obtainable charge, and is defined as $4\epsilon_o E/J$, where $\epsilon_o$ is the dielectric constant of air and is equal to $8.8\times10^{-12}$ farads per meter, E is the electric field in the charging zone, and J is the current density. Since J is equal to the charge density per pulse (u) times $f_2$, this relationship (4) requires that $4\epsilon_o E v_g$ be less than $f_2 uL$.

Relationship (5)

The ac frequency, $f_1$, should be a multiple of the pulse repetition frequency, $f_2$, to allow synchoronization. From a cost standpoint it is also advisable to make $f_1$ as small as possible.

For a preionizing wire inside a typical precipitator the relationships (1) to (5) are not very restrictive, as the following example for typical values for the various parameters (such as D, L, Vg. etc) demonstrates.

EXAMPLE

The following are typical values of the following parameters:

D=0.3 meter

L=0.3 meter

Vg=1.5 meters/second

Vac=30 meters/second

Vp=100 meters/second $u=5\times10^{-6}$ ampere-seconds/meter$^2$/pulse $E=5\times10^5$ volts/meter Relationship (1) will be satisfied if the ac frequency $f_1$ can be selected high enough to reduce the spatial amplitude d to the required level. A frequency $f_1$ of 500 hertz results in a value of d which is 0.1 D, and this satisfies the first relationship.

Relationship (2) will be satisfied if the pulse repetition frequency is high enough to give the required rate of displacement $f_2 V_p t_o$ per second. A frequency $f_2$ of 100 pps results in a rate of displacement of $10^4 t_o$ per second. The time interval during which displacement occurs is $L/Vg=0.3/1.5=0.2$ seconds. The resulting displacement is $2000t_o$. The maximum permissible displacement is $D/2=0.15$. This will not be exceeded if $t_o$ is set at 75 microseconds, since such a pulse width results in a displacement of 0.15, which is the maximum permissible displacement.

Relationship (3) is satisfied by the foregoing values of the parameters, since $V_pt_o=100\times75\times10^{-6}=7.5\times10^{-3}$, and this is less than d, which is 0.03.

Relationship (4) is also satisfied by foregoing parameters, since $4\epsilon_o E v_g=4\times8.8\times10^{-12}\times5\times10^5\times1.5=264\times10^{-7}$, and this is less than $f_2uL$, which is $100\times5\times10^{-6}\times0.3=150\times10^{-6}$.

Relationship (5) is satisfied by the foregoing values of the parameters, since $f_1=5f_2$.

PHYSICAL LAYOUT

To accomplish effective particulate collection one would choose a combination of charging sections and collecting sections in series. One could envisage a precipitator with only one charging section in front of a series of collecting sections or a charging section in front of every collecting section or any in-between arrangement. As shown in FIG. 1, the charging section may be quite similar to the collecting sections, except that the charging section must be electrically decoupled from the collecting sections. In the precipitator of FIG. 1 the gas stream travels from left to right, passing through conventional collecting plates 13. For retrofit applications one could for example place the charging section in the precipitator inlet duct or between existing sections. One promising arrangement might utilize only a portion of each precipitator section as a charging section—for example only the area adjacent to the inlet wire might act as a charging section while the rest of the wires are energized in the conventional way.

Figure 3:
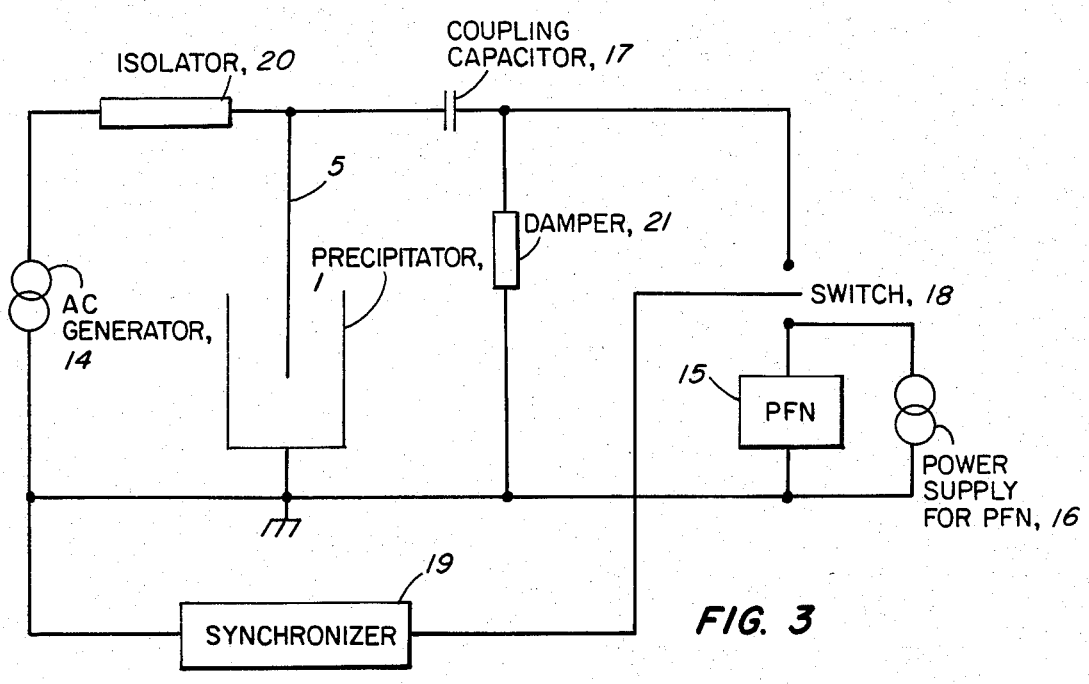
FIG. 3 is a schematic circuit diagram suitable for applying ac voltage and pulses to the electrodes of the charging stage of the precipitator of FIG. 1.

FIG. 3 is a schematic circuit diagram of a system capable of applying ac voltage and pulses to the corona emitting electrodes of an electrostatic precipitator. Such circuit can be used to carry out the invention by applying a combination of ac voltage and pulses to the corona electrodes 5 of the charging stage 2. In the circuit of FIG. 3 an ac generator 14 produces the ac voltage required by the invention and applies it to the corona electrodes 5 of the precharger section 2. The pulse voltage is generated by charging a pulse forming network 15 from a separate power supply 16. The pulse is applied to the corona electrodes 5 of the precipitator via a coupling capacitor 17 after closure of a switch 18 has been intiated by a synchronizer 19. An isolator 20 in the ac voltage circuit acts as a high electrical impedance for the pulse voltage and assures that most of the pulse voltage is applied to the precipitator 1. The isolator 20 also serves as a means to protect the ac generator from the pulse generator.

The synchronizer 19 coordinates the pulse rate of the pulse forming network 15 with the frequence of the ac generator. The synchronizer 19 can also serve as a means to apply the pulse voltage at a very specific phase of the ac cycle.

A damper 21, together with the coupling capacitor 17, isolates the voltage of the ac generator 14 from the pulse forming section which comprises the pulse forming network 15 and its power supply 16. In specific cases it should be possible to operate without the coupling capacitor 17 and damper 21 and use the switch 18 itself as the isolation means. In some instances a magnetic coupling arrangement (not shown) might be used instead of the coupling capacitor 17.

PULSE POLARITY

The principles of the invention are applicable to both polarities. In the case of negative pulse voltage one would however deal with both electrons and negative ions, which possess vastly different migration velocities. In other words, electrons could already reach the non-corona electrode while the negative ions have barely left the corona wire. If the proportion of electrons to the total current is very high, the oscillation frequency would have to be adjusted to the electron mobility. If on the other hand, the majority of electrons get quickly attached and form negative ions, then the operation should function the same as for positive polarity. In the case where electron and negative ion current are comparable, problems might be encountered. Experiments to determine exact behavior are well within the capabilities of those skilled in this art.

APPLICATION

The application of the principles of the invention is not restricted to standard electrostatic precipitators. It would be quite possible to apply these principles to precipitators of wide plate spacing or precipitators having larger diameter corona wires or completely non-standard corona wires.

In principle the charging system of the invention could find application wherever a charge should be applied to a particle and an efficient charging scheme is desired.

Having thus described the principles of the invention, together with illustrative embodiments thereof, it is to be understood that although specific terms are employed, they are used in a generic and descriptive sense, and not for purposes of limitation, the scope of the invention being set forth in the following claims.

I claim:

1. Apparatus for charging gaseous particles, comprising a charging zone for passage of a gas therethrough along a first dimension, at least one corona electrode within said zone and at least one non-corona electrode within said zone, said electrodes positioned and arranged to define at least one pair within said zone, the electrodes in each said at least one pair being so arranged that said gas flows therebetween, voltage-application means for applying a continuous ac voltage and a periodic unipolar pulsed voltage across each said at least one pair, said voltage-application means being so constructed that (a) said ac voltage is insufficient to produce by itself significant corona current, (b) the voltage of said pulse is high enough to produce the desired quantity of ions and low enough to avoid initiating breakdown, (c) the duration and repetition rate of said pulsed voltage is sufficiently great so that said ions are propagated towards said at least one non-corona electrode and fill the charging zone before leaving it, and (d) the spatial amplitude of the oscillating motion of said ions due to said ac voltage is much smaller than the dimensions of said charging zone transverse to said first dimension but greater than the displacement of said ions during propagation during each pulse of said pulsed voltage.

2. Apparatus according to claim 1, wherein said voltage-application means is so constructed that the period of oscillation of said ac voltage is sufficiently short so that the ions oscillate within the charging zone without being intercepted by the at least one non-corona electrode.

* * * * *